United States Patent [19]

Takahashi

[11] 4,290,687

[45] Sep. 22, 1981

[54] APPARATUS FOR DEVELOPING PHOTOGRAPHED FILM

[76] Inventor: Hidehiko Takahashi, 15-4, Soshigaya 4-chome, Setagaya-ku, Tokyo, Japan

[21] Appl. No.: 133,684

[22] Filed: Mar. 25, 1980

[30] Foreign Application Priority Data

Apr. 3, 1979 [JP] Japan ..... 54/43133[U]

[51] Int. Cl.[3] ..... G03D 3/00

[52] U.S. Cl. ..... 354/320; 354/330; 134/157

[58] Field of Search ..... 354/89, 90, 91, 92, 354/312, 313, 316, 319, 320, 321, 322, 329, 330, 335; 134/157

[56] References Cited

U.S. PATENT DOCUMENTS

| | | | |
|---|---|---|---|
| 2,168,846 | 8/1939 | Parker | 354/330 |
| 2,975,695 | 3/1961 | Tsuno | 354/316 |
| 3,010,377 | 11/1961 | Kettler | 354/316 |
| 3,605,601 | 9/1971 | Okayama et al. | 354/335 |
| 4,011,573 | 3/1977 | Braico | 354/329 |

FOREIGN PATENT DOCUMENTS

| | | | |
|---|---|---|---|
| 600505 | 3/1978 | U.S.S.R. | 354/316 |

*Primary Examiner*—L. T. Hix
*Assistant Examiner*—Alan Mathews
*Attorney, Agent, or Firm*—Wenderoth, Lind & Ponack

[57] ABSTRACT

An apparatus for developing a photographed film comprises a turn table on which processing liquid cups are mounted, a rotary device for rotating the film to be developed, and a device for descending and ascending the rotary device into and out of the liquid cups, respectively. The rotary device is formed separately from the descending and ascending device but is detachably supported thereon. The rotary device comprises a housing, a small motor contained in the housing with an output shaft thereof connected to an outwardly projecting rotary member, and a cylindrical holder for detachably holding the housing thereon, the holder having a hollow space adapted to snugly contain a magazine of the film which has a rotary spool engageable with the rotary member projecting from the housing.

4 Claims, 4 Drawing Figures

APPARATUS FOR DEVELOPING PHOTOGRAPHED FILM

BACKGROUND OF THE INVENTION

This invention relates to a film developing apparatus of the type which can develop a photographed roll of film by rotating the film in one and then the other direction in a liquid developer.

An automatic film developing apparatus has been provided as shown in U.S. Pat. No. 3,605,601 in which several processing cups containing processing liquids therein are positioned on a turntable. A roll of film to be developed is contained in a cassette or magazine and supported on a rotary shaft which can descend and ascend into and out of the processing cup at predetermined times when one of the processing cups is directly below the rotary shaft.

Such film developing apparatus has the advantage of developing the photographed film automatically. However, some disadvantages have been experienced with the apparatus due to its structure of the rotary shaft being integral with means for descending and ascending it. For example, when a rotary shaft and/or a turn table upon which the processing liquid cups are provided are accidentally stopped, the developing process cannot proceed further, thus the film cannot be developed as desired. Further, it is often the desire of a skilled photographer to vary the preset processing time period in each or a number of the processing liquids in order to develop the film with desired coloring. In the automatic film developing apparatus set forth above, the processing time period in each processing liquid is preset, and it is troublesome to adjust these processing time periods in accordance with those desired by the photographer. In addition, it has been troublesome in the apparatus set forth above to attach and detach a magazine containing the film to and from the rotary shaft.

BRIEF SUMMARY OF THE INVENTION

Accordingly, an object of the present invention is to provide a film developing apparatus which can develop a roll of film when a turn table, upon which processing liquid cups are provided, and/or a means for ascending and descending a film to be developed are accidentally stopped.

Another object of the present invention is to provide a film developing apparatus which allows a developer to vary each processing time period from a preset standard to one that he desires.

A further object of the present invention is to provide a film developing apparatus in which a magazine or cassette containing a film to be developed can be very easily attached and detached, respectively, before and after developing.

According to the present invention, an apparatus develops photographic film by rotating the film in a liquid developer. The apparatus comprises a case body, a liquid chamber for containing heated water, a turn table rotatably mounted on the case body above the liquid chamber, processing liquid cups mounted on the turn table and downwardly projecting into the liquid chamber, means for descending and ascending a magazine or cassette containing the film to be developed which comprises a vertical shaft extending through the case body which is movable up and down and a horizontal arm extending above said turn table from the vertical shaft, and means for rotating the film to be developed in one and then the other direction. The rotataing means comprises a housing, a small motor contained in the housing with an output shaft thereof connected to a rotary member which projects downwardly from the housing, and a cylindrical holder for detachably holding the housing thereon. The holder has a cylindrical hollow space therein and a flange portion which supports the holder on the horizontal arm. The hollow space in the holder is adapted to snugly contain the magazine or cassette which has a rotary spool engageable with the rotary member projecting downwardly from the housing.

Other objects and features of the present invention will become apparent from the following detailed description of a preferred embodiment when taken in conjunction with the accompanying drawings.

DETAILED DESCRIPTION OF THE INVENTION

Figure 1:
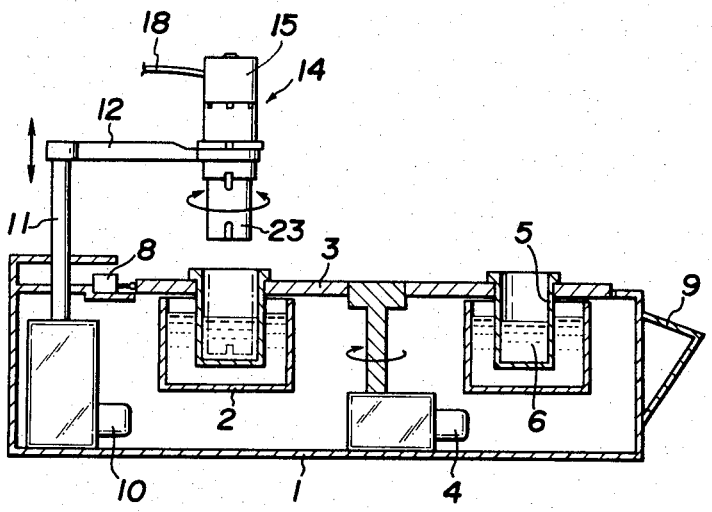
FIG. 1 is a partially sectioned side view showing a film developing apparatus according to an embodiment of the present invention.
Figure 2:
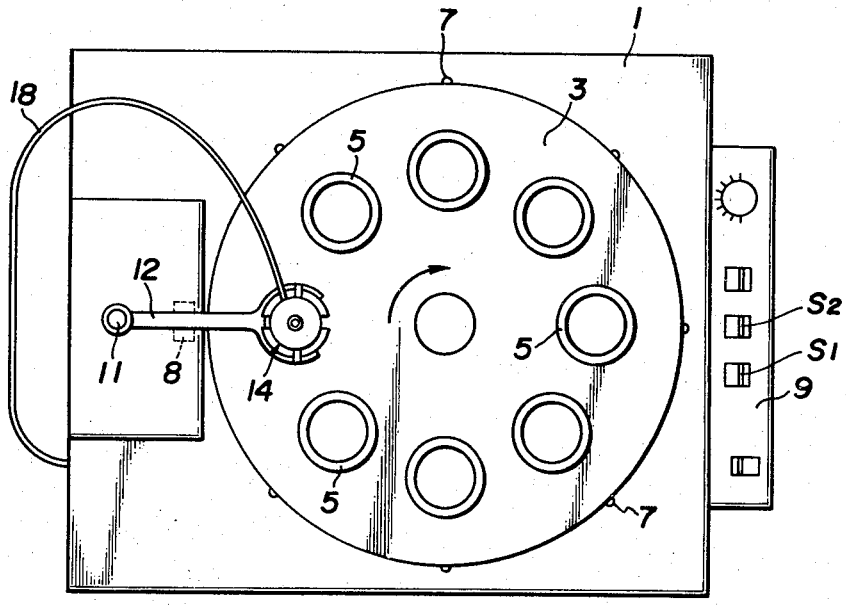
FIG. 2 is a top plan view showing the apparatus in FIG. 1.

Referring to FIGS. 1 and 2, an apparatus for developing a color film comprises a case body 1 in which therein is an annular water chamber 2. The water chamber 2 therein has a heater unit (not shown) and a thermostat, so that water stored therein is heated and kept at a predetermined temperature suited for developing film. Provided above the water chamber 2 is a turn table 3 which is rotated by a motor 4 in the case body 1. The turn table 3 has a series of circular holes therethrough in which cup-shaped containers 5—5 are detachably inserted from the top thereof. Each cup-shaped container 5 has an annular flange by which it is supported on the turn table 3. When a container is inserted into the turn table, it is partially submerged in the heated water in the water chamber 2. These cup-shaped containers 5—5 contain developer, water, or other liquid 6, which are arranged in the order of the film developing process. The turn table 3 has conductive projections 7—7 at the periphery thereof which correspond in number to the cup-shaped containers 5—5 and are provided along the radial extensions of the containers 5—5. In order to cooperate with these conductive projections 7—7, a micro-switch 8 is provided on the case body 1. When the microswitch 8 is activated by contact with a conductive projection 7, an electric signal is supplied to a control box 9 in the case body, which supplies another electric signal to the motor 4 in order to rotate the turn table at a predetermined time period. When the turn table is rotated, the next succeeding conductive projection contacts the micro-switch.

The case body 1 has another motor 10 for ascending and descending a vertical shaft 11 to which a horizontal arm 12 is integrally connected. The horizontal arm 12 has forked semi-circular ends 13 in which a film rotary device 14 is inserted and detachably supported thereon.

Figure 3:
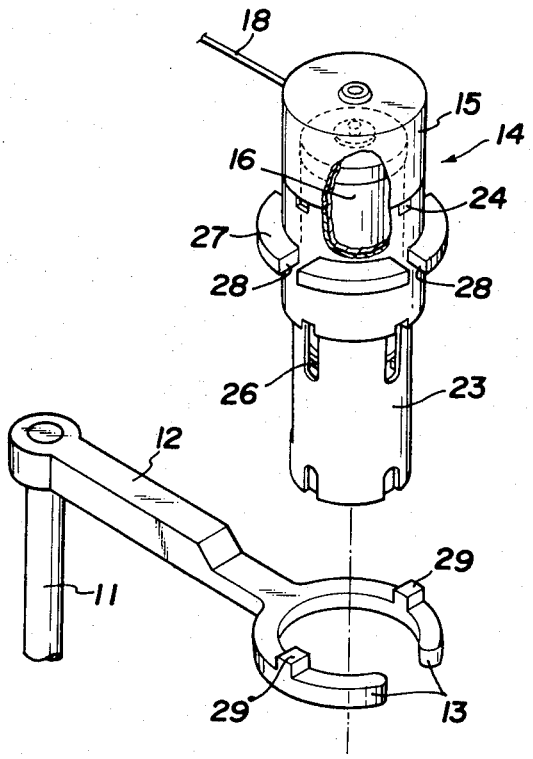
FIG. 3 is a partially exposed perspective view showing the essential parts of the present apparatus.
Figure 4:
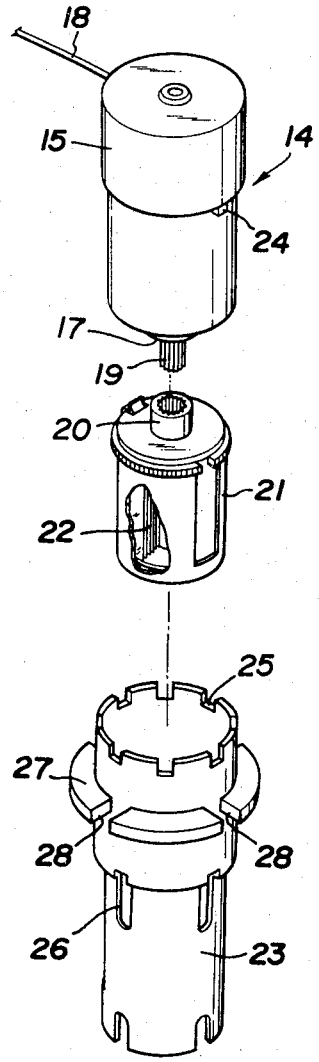
FIG. 4 is a perspective view showing an assembly of the essential parts of the present apparatus.

As shown in FIGS. 3 and 4, the film rotary device 14 comprises a motor housing 15 in which a micro-motor 16 is snugly contained. The micromotor 16 has speed reduction gears. The output shaft of motor 1*a* is firmly connected to a rotary member 17 which projects downwardly from the housing 15. The motor housing 15 also contains a detector (not shown) which detects the number of rotations of the output shaft. This detector produces a pulse for every rotation of the output shaft. The produced pulses are supplied to the control box 9 in the case body 1 through a flexible cable 18. When the number of pulses counted in control box 9 reaches a predetermined value, the polarity of the electric current supplied to the motor 16 is reversed, whereby the rotary direction of the motor is reversed after the motor has rotated for the predetermined number of rotations. Thus, the rotational direction of the rotary member 17 is reversed. The rotary member 17 has a gearshaped projection 19 which is snugly engaged with a rotary spool 20 of a cassette or magazine 21 which contains a photographed roll of film 22. The magazine has a known light impermeable but liquid permeable structure.

The motor housing 15 is supported by a cylindrical holder 23 by partially inserting the former into the latter. The motor housing 15 has a pair of projections 24—24 on the side surface thereof which are engaged with notches 25—25 at the upper end of the holder 23 when assembled, so that the rotation of the motor housing 15 relative to the cylindrical holder 23 is prevented. The holder 23 has a cylindrical hollow space within which the magazine 21 is snugly fitted so as not to rotate therein. The magazine 21 to be used in the present embodiment has an outer cup-shaped casing and an inner cup-shaped casing which combine with each other by inserting the open end of the inner casing into the open end of the outer casing. The holder 23 has a plurality of slot-shaped openings 26 through the cylindrical wall thereof, which allow the smooth flow of developer or other liquid into the hollow space in the holder. The holder 23 also has an annular flange 27 at the upper part thereof which is partially cut out forming portions 28. When the cylindrical holder 23 is inserted into a space defined by the forked ends 13, the annular flange 27 rests upon the forked ends 13, so that the cylindrical holder is supported on the forked ends of the horizontal arm 12. Preferably, the forked ends 13 have projections 29 thereon which are provided to snugly engage with the cut-out portions 28 in the annular flange 27. In the structure set forth above, when the film rotary device 14 is supported by the forked ends of the horizontal arm 12, the film rotary device is located directly above one of the cup-shaped containers 5.

Referring to an operation of the film developing apparatus set forth above, when a reset switch $S_1$ on the control box 9 is activated, the turn table 3 is rotated to a starting position where the first developer liquid in a first cup-shaped container 5 is located directly below the film rotary device 14. Then, when a start switch $S_2$ is activated, the micromotor 16 in the film rotary device rotates in one direction for a predetermined number of rotations and then in the other direction for the predetermined number of rotations, whereby the roll of film 22 contained in the magazine 21 is rotated in one and then the other direction since the spool 20 is engaged with the rotary member 17 connected to the output shaft of the motor. At the same time, the motor 10 is driven to lower the vertical shaft 11, whereby the cylindrical holder 23 as well as the magazine 21 both supported by the horizontal arm 12 are lowered into the first developer liquid contained in the cup-shaped container 5. Thus, the roll of film in the magazine is immersed in the liquid developer and rotated in one and then in the other direction therein. After a predetermined period of time, which is preset by a program timer in the control box 9, the vertical shaft 11 is raised and film rotary device 14 is elevated above the turn table. Then, the turn table 3 is rotated until the next succeeding conductive projection 7 at the periphery thereof contacts the micro-switch 8 causing the turn table 3 stop rotating, where the succeeding processing liquid in the next cup-shaped container 5 is placed directly below the film rotary device 14. Thereafter, the vertical shaft 11 as well as the film rotary device are lowered in the same manner as set forth above. Such rotation of the turn table and ascending and descending movements of the film rotary device are carried out by a program timer in the control box. The programming of the timer can be made in accordance with a manner known to those skilled in the art so as to correspond to the processing time periods of the film to be developed. Since the programming for operating the present apparatus is not an essential part of the present invention, a detailed explanation thereof is omitted herein.

As will be understood from the disclosure set forth above, the film developing apparatus of the present invention has several advantages due to the structure that allows the film rotary device to be separated from the means for descending and ascending it. For example, even if the turn table or the descending and ascending means becomes inoperative for some reason in the course of the film developing process, the rotary device can be separated therefrom by manually lifting it up and away from horizontal arm 12. And then, the device can be manually dipped into the processing liquid successively in turn, so that the film developing process can be completed. Further, when the operator wishes to vary at least one of the preset standard processing time periods in at least one of the developing steps in order to obtain desired coloring, he can separate the film rotary device during the course of film film developing process and manually increase or decrease the dipping time of the magazine in one or some of the processing liquids. Moreover, when the magazine containing the roll of film is to be attached to or removed from the film rotary device, the operation can be accomplished very easily by separating the film rotary device as set forth above.

In addition, according to the present film developing device, the motor for rotating the film to be developed is contained in the film rotary device as an integral part thereof.

Accordingly, batteries could be used to rotate the device 14, thereby avoiding a film developing process failure due to an unexpected interruption of electricity to the turn table and the ascending and descending means.

Although the present invention has been described with reference to a preferred embodiment thereof, modifications and alterations may be made within the spirit of the present invention.

What is claimed is:

1. An apparatus for developing a photographed film roll by rotating the roll in a liquid developer, said apparatus comprising:

a case body;

a liquid chamber mounted on said case body;

a turn table rotatably mounted on said case body above said liquid chamber;

processing liquid cup-shaped containers detachably mounted on said turn table and downwardly projecting into said liquid chamber;

a cassette or magazine for housing a photographed film roll having a liquid permeable structure;

means for descending and ascending said cassette or magazine into and out of said containers, said means comprising:

a vertical shaft movable in the vertical direction and extending through said case body, and a horizontal arm extending above said turn table and connected to said vertical shaft;

means for rotating a photographed film roll in one and then the other direction, said means comprising:

a housing adapted to contain a motor, a motor positioned in said housing and having an output shaft, a rotary member connected to said output shaft and outwardly projected through said housing, and a cylindrical holder detachably holding said housing, said holder having a peripheral wall including a flange portion detachably holding said cylindrical holder on said horizontal arm, and a hollow space surrounded by said wall and snugly containing said cassette or magazine; and a rotary spool projecting into said cassette or magazine and rotatably connected thereto, said spool having one end connected to said rotary member and another end connected to a photographed film roll whereby when said motor imparts a rotational movement to said rotary member through said output shaft said spool imparts a corresponding rotational movement to a film roll.

2. An apparatus as claimed in claim 1, wherein said peripheral wall has an opening therethrough to enable processing liquid contained in said cup-shaped containers to communicate with said magazine or cassette contained in said hollow space.

3. An apparatus as claimed in claim 1, wherein said rotating means includes a detector positioned in said housing for detecting the number of revolutions of said motor and supplying an electric signal for reversing the rotational direction of said motor.

4. An apparatus as claimed in claim 1, wherein said horizontal arm has forked semi-circular ends upon which said flange portion on said cylindrical holder rests.

* * * * *